US009925814B2

(12) United States Patent
Araki et al.

(10) Patent No.: US 9,925,814 B2
(45) Date of Patent: Mar. 27, 2018

(54) RECORDING MEDIUM

(71) Applicant: CANON KABUSHIKI KAISHA, Tokyo (JP)

(72) Inventors: Kazuhiko Araki, Kawasaki (JP); Hisao Kamo, Ushiku (JP); Tetsuro Noguchi, Hachioji (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/878,888

(22) Filed: Oct. 8, 2015

(65) Prior Publication Data

US 2016/0101640 A1 Apr. 14, 2016

(30) Foreign Application Priority Data

Oct. 10, 2014 (JP) ..... 2014-209477

(51) Int. Cl.
*B41M 5/50* (2006.01)
*B41M 5/52* (2006.01)

(52) U.S. Cl.
CPC ..... *B41M 5/502* (2013.01); *B41M 5/506* (2013.01); *B41M 5/52* (2013.01); *B41M 5/508* (2013.01); *B41M 5/529* (2013.01); *B41M 5/5218* (2013.01); *B41M 5/5254* (2013.01); *B41M 2205/42* (2013.01)

(58) Field of Classification Search
CPC ..... B41M 5/50; B41M 5/502; B41M 5/506; B41M 5/508; B41M 5/5218
See application file for complete search history.

(56) References Cited

U.S. PATENT DOCUMENTS

| | | | | |
|---|---|---|---|---|
| 7,984,983 | B2 * | 7/2011 | Kawakami | B41M 5/0023 106/31.13 |
| 2011/0135855 | A1 * | 6/2011 | Oguri | B41M 5/502 428/32.25 |
| 2011/0256324 | A1 * | 10/2011 | Noguchi | B41M 5/52 428/32.24 |
| 2014/0004282 | A1 * | 1/2014 | Nito | B41M 5/5218 428/32.25 |

FOREIGN PATENT DOCUMENTS

| | | | |
|---|---|---|---|
| EP | 1580016 | A1 | 9/2005 |
| JP | H11-129611 | A | 5/1999 |
| JP | 2009226684 | A | 10/2009 |
| JP | 2010-099991 | A | 5/2010 |
| JP | 2011161841 | A | 8/2011 |
| JP | 2011-194735 | A | 10/2011 |
| JP | 2013-022733 | A | 2/2013 |

* cited by examiner

*Primary Examiner* — Betelhem Shewareged
(74) *Attorney, Agent, or Firm* — Canon U.S.A., Inc. IP Division

(57) ABSTRACT

A recording medium includes in this order a water-resistant substrate, a first ink receiving layer, and a second ink receiving layer that is the outermost layer. The first ink receiving layer contains a fumed silica and a binder. The second ink receiving layer contains a colloidal silica having an average primary particle diameter of 50 nm or more and 100 nm or less, and a polyvinyl alcohol having a silanol group.

9 Claims, No Drawings

RECORDING MEDIUM

BACKGROUND OF THE INVENTION

Field of the Invention

The present disclosure relates to a recording medium.

Description of the Related Art

Recording media on which images including text and graphics will be recorded using an ink jet recording apparatus or the like are required to allow the recorded images to exhibit higher color developability. In addition, as the recording speed is increased, it is desired that the recording media have a higher resistance to damage or scratches caused by high stress placed thereon when conveyed at a high speed (this resistance is hereinafter referred to as scratch resistance).

For recording media, a water-resistant substrate is known in which cockling, such as creases and waves, does not easily occur after recording. The water-resistant substrate may be a resin-coated substrate produced by coating a base paper with a resin film, or a plastic substrate, such as a polyethylene terephthalate (PET) film. Recording media using a water-resistant substrate are smoother than those using a paper substrate, and tend to be damaged by being rubbed with another recording medium when being conveyed. High scratch resistance is particularly desired. Water-resistant substrates do not absorb ink. In order to impart ink absorbency to a recording medium using a water-resistant substrate, the porosity of the ink receiving layer is increased by increasing the percentage of the inorganic particles in the ink receiving layer relative to the binder therein. If the percentage of the binder in the ink receiving layer is reduced, however, the scratch resistance of the recording medium tends to be reduced undesirably. Hence, it has been difficult for known techniques to achieve a recording medium that can exhibit both high scratch resistance and high ink absorbency while using a water-resistant substrate.

In order to increase the ink absorbency of a recording medium using a water-resistant substrate, Japanese Patent Laid-Open No. 11-129611 discloses a recording medium including a PET film and a single ink receiving layer containing a colloidal silica and a polyvinyl alcohol having a silanol group (hereinafter referred to as silanol-modified PVA in some cases) on the PET film.

Although the paper substrate is not water-resistant substrate, Japanese Patent Laid-Open Nos. 2013-022733 and 2010-099991 each disclose a recording medium including a paper substrate and an ink receiving layer containing a colloidal silica and a silanol-modified PVD on the paper substrate.

SUMMARY OF THE INVENTION

A recording medium according to an embodiment of the present disclosure includes, in the following order, a water-resistant substrate, a first ink receiving layer, and a second ink receiving layer that is the outermost layer. The first ink receiving layer contains a fumed silica and a binder. The second ink receiving layer contains a colloidal silica having an average primary particle diameter of 50 nm or more and 100 nm or less, and a polyvinyl alcohol having a silanol group.

Further features of the present invention will become apparent from the following description of exemplary embodiments.

DESCRIPTION OF THE EMBODIMENTS

According to research by the present inventors, the ink absorbency of the recording medium disclosed in Japanese Patent Laid-Open No. 11-129611 is improved, but is not sufficient to satisfy the level that has recently been desired. Also, this recording medium exhibited a low scratch resistance, and the color developability of images formed on the recording medium was poor. The recording media disclosed in Japanese Patent Laid-Open No. 2013-022733 or 2010-099991 cause cockling because of using a paper substrate.

Accordingly, the present invention is directed to providing a recording medium in which cockling is suppressed by using a water-resistant substrate, and which can have high scratch resistance and high ink absorbency and allows images formed thereon to exhibit high color developability. The present application will be further described using exemplary embodiments.

The present inventors first studied the reason why the known recording media cannot overcome the above-described disadvantages. As a result, even though a water-resistant substrate was provided thereon with an only one ink receiving layer containing a colloidal silica and a silanol-modified PVA, the ink receiving layer did not fully function as expected, and the resulting images did not exhibit satisfactory color developability.

The present inventors studied an approach to increasing the ink absorbency and the scratch resistance of the recording medium and to allowing images formed on the recording medium to exhibit high color developability, thus having devised a recording medium disclosed herein. More specifically, the recording medium includes a water-resistant substrate and two ink receiving layers (a first ink receiving layer and a second ink receiving layer) disposed on the water-resistant substrate. The first ink receiving layer contains a fumed silica and a binder, and the second ink receiving layer contains a colloidal silica having an average primary particle diameter of 50 nm or more and 100 nm or less, and a polyvinyl alcohol having a silanol group. Such a recording medium can overcome the above-described disadvantages of the known recording medium using a water-resistant substrate. The reason of this is as below.

First, the first ink receiving layer considerably contributes to the ink absorbency of the recording medium and the color developability of the resulting images. This is because the fumed silica in the first ink receiving layer has a porous structure having a high liquid absorbency sufficient to compensate for an insufficient ink absorbency of the second ink receiving layer, and also has a transparency not affecting the color developability of the images.

In addition, the outermost layer, or second ink receiving layer, subject to an external stress contains colloidal silica that is highly resistant to scratches or the like. The presence of the colloidal silica increases the scratch resistance of the recording medium. It is also supposed that the polyvinyl alcohol having a silanol group used as a binder in combination with the colloidal silica increases the pore size and accordingly increases ink absorption in comparison with the case of using other binders (for example, a polyvinyl alcohol not modified), and that the combination of such a second ink receiving layer and the first ink receiving layer capable of rapidly absorbing ink increases the ink absorbency of the recording medium. If the colloidal silica has an average primary particle diameter of less than 50 nm, a sufficient increase of ink absorbency is not expected. On the other hand, if the average primary particle diameter is larger than 100 nm, the transparency of the recording medium is reduced, and the resulting images cannot have satisfactory color developability.

Synergistic interaction between those components or members of the recording medium produces advantageous effects as intended, as described above.

Recording Medium

The recording medium according to an embodiment includes a water-resistant substrate, a first ink receiving layer, and a second ink receiving layer that is an outermost layer. An additional layer may be formed between the substrate and the first ink receiving layer or between the first ink receiving layer and the second ink receiving layer. The recording medium may be suitable for use in ink jet recording method. Each components of the recording medium will be described.

Water-Resistant Substrate

The water-resistant substrate may be a resin-coated substrate produced by coating a base paper with a resin film, a plastic substrate, such as a polyethylene terephthalate (PET) film, or a glass or metal substrate. Advantageously, the water-resistant substrate includes a base paper and a resin layer, that is, the water-resistant substrate is a base paper coated with a resin. In this instance, the resin layer may be formed only on one side of the base paper. It is however advantageous that both sides of the base paper are coated with the resin layer.

Base Paper

The base paper is mainly made of wood pulp, and may optionally contain a synthetic pulp such as polypropylene, or a synthetic fiber such as nylon or polyester. Exemplary wood pulp include leaf bleached kraft pulp (LBKP), leaf bleached sulfite pulp (LBSP), needle bleached kraft pulp (NBKP), needle bleached sulfide pulp (NBSP), leaf dissolving pulp (LDP), needle dissolving pulp (NDP), leaf unbleached kraft pulp (LUKP), and needle unbleached kraft pulp (NUKP). These pulps may be used singly or in combination. LBKP, NBSP, LBSP, NDP and LDP, which contain short fiber components, are advantageous. Pure chemical pulp is also advantageous such as sulfate pulp or sulfite pulp. Pulps bleached to increase the whiteness are also advantageous. The base paper may further contain a sizing agent, a white pigment, a reinforcing agent, a fluorescent brightening agent, a moisturizing agent, a dispersant, a softening agent, or the like, if necessary.

The base paper may have a thickness of 50 μm or more and 130 μm or less, such as 90 μm or more and 120 μm or less. The thickness of the base paper mentioned herein is determined by the following procedure. First, the recording medium is cut to expose a section with a microtome, and the section is observed by scanning electron microscopy. The thickness of the base paper is measured at arbitrarily selected 100 points or more, and the average of the measured thicknesses is defined as the thickness of the base paper. The thicknesses of other layers are also determined in the same manner.

The density of the base paper specified in JIS P 8118 is desirably 0.6 g/cm$^3$ or more and 1.2 g/cm$^3$ or less. More desirably, it is 0.7 g/cm$^3$ or more and 1.2 g/cm$^3$ or less.

Resin Layer

If the base paper is coated with a resin layer, the resin layer may cover a part of the surface of the base paper, but the percentage of the resin layer coating the base paper (surface area of the base paper coated with the resin layer/entire area of the base paper) is desirably 70% or more, more desirably 90% or more, and still more desirably 100%. Hence, it is advantageous that the entire surface of the base paper be coated with the resin layer.

The resin layer may have a thickness of 20 μm or more and 60 μm or less, such as 35 μm or more and 50 μm or less. If the resin layer is formed on both sides of the base paper, each resin layer desirably has a thickness within these ranges.

The resin layer can be made of a thermoplastic resin. Examples of the thermoplastic resin include acrylic resin, acrylic silicone resin, polyolefin resin, and styrene-butadiene copolymer. Among these, polyolefin resin is advantageous. The polyolefin resin mentioned herein refers to a polymer using an olefin as a monomer. More specifically, the polyolefin resin may be a homopolymer or copolymer containing one or more monomers such as ethylene, propylene, and isobutylene. The polyolefin resin may be a single compound or include two or more polyolefins. Among polyolefins, polyethylene is advantageous. The polyethylene may be a low density polyethylene (LDPE) or a high density polyethylene (HDPE).

The resin layer may contain a white pigment, a fluorescent brightening agent or ultramarine blue to adjust opacity, whiteness or hue. In particular, a white pigment is effective in improving the opacity of the recording medium. The white pigment may be titanium oxide in the form of rutile or anatase. In the present embodiment, the white pigment content in the resin layer may be 3 g/m$^2$ or more and 30 g/m$^2$ or less. If the resin layer is formed on both sides of the base paper, it is advantageous that the total mass of the white pigment in the two resin layers be within this range. In addition, the ratio of the white pigment to the resin in the resin layer is desirably 25% or less, in view of the dispersion stability of the white pigment.

The arithmetic average surface roughness Ra specified in JIS B 0601: 2001 of the resin layer may be 0.01 μm or more and 5 μm or less, such as 0.03 μm or more and 4 μm or less.

First Ink Receiving Layer

The first ink receiving layer contains a fumed silica and a binder. The first ink receiving layer may be formed on both sides of the substrate. The first ink receiving layer desirably has a thickness of 10 μm or more and 60 μm or less, such as 15 μm or more and 45 μm or less.

Fumed Silica

The fumed silica used in the first ink receiving layer is produced by high temperature gas phase hydrolysis (flame hydrolysis) of a silicon halide, or a process (arc process) in which silica sand is heated with coke to be reduced and evaporated by arc in an electric furnace, followed by oxidizing the evaporated gas with air. Examples of the fumed silica include AEROSIL (produced by Nippon Aerosil) and Reolosil QS series (produced by Tokuyama).

In the present embodiment, the fumed silica desirably has an average secondary particle diameter of 50 nm or more and 300 nm or less.

The specific surface area of the fumed silica determined by the BET method may be 50 m$^2$/g or more and 400 m$^2$/g or less, such as 200 m$^2$/g or more and 350 m$^2$/g or less.

Desirably, the fumed silica is dispersed in the ink receiving layer coating liquid and is thus used in the form of dispersion liquid. The fumed silica in a dispersion desirably has a particle diameter of 50 nm or more and 300 nm or less. The particle diameter of the fumed silica in a dispersion can be measured by dynamic light scattering.

Binder

The first ink receiving layer contains a binder. The term binder refers to a material that can bind inorganic particles together to form a coating.

In the present embodiment, the binder content is desirably 50% by mass or less, such as 30% by mass or less, relative to the content of inorganic particles in the first ink receiving layer, in view of ink absorbency. Also, the binder content in the first ink receiving layer is desirably 5.0% by mass or more, such as 8.0% by mass or more, in view of the binding property of the ink receiving layer.

Examples of the binder include starch derivatives, such as oxidized starch, etherified starch, and phosphoric acid-esterified starch; cellulose derivatives, such as carboxymethyl cellulose and hydroxyethyl cellulose; casein, gelatin, soy protein, polyvinyl alcohol, and derivatives thereof; conjugated polymer latexes, such as polyvinyl pyrrolidone, maleic anhydride resin, styrene-butadiene copolymer, and methyl methacrylate-butadiene copolymer; acrylic polymer latex, such as polymers of an acrylic ester and a methacrylic ester; vinyl polymer latexes, such as ethylene-vinyl acetate copolymer; functional group-modified polymer latexes of monomers having a functional group such as the carboxy group of the above polymers; products of cationization of the above-mentioned polymers with a cationic group; products of cationization at the surface of any of the above-cited polymers with a cationic surfactant; polymers of polymerization of any monomer of the above-cited polymers in the presence of a cationic polyvinyl alcohol, having surfaces at which the polyvinyl alcohol is distributed; polymers of polymerization of any monomer of the above-cited polymers in a cationic colloid particles-suspended dispersion, having surfaces at which cationic colloid particles are distributed; aqueous binders, such as melamine resin, urea resin, and other thermosetting synthesized resins; polymers and copolymers of methacrylic esters and acrylic esters, such as polymethyl methacrylate; and other synthetic resins such as polyurethane resin, unsaturated polyester resin, vinyl chloride-vinyl acetate copolymer, polyvinyl butyral, and alkyd resin. These binders may be used singly or in combination.

Among these binders, polyvinyl alcohol and derivatives thereof are advantageous. Exemplary polyvinyl alcohol derivatives include cation-modified polyvinyl alcohols, anion-modified polyvinyl alcohols, silanol-modified polyvinyl alcohols, and polyvinyl acetal. In the present embodiment, polyvinyl alcohol is advantageous as the binder of the first ink receiving layer.

Polyvinyl alcohol can be synthesized by, for example, saponifying polyvinyl acetate. The saponification degree of the polyvinyl alcohol may be 80% by mole or more and 100% by mole or less, such as 85% by mole or more and 98% by mole or less. A saponification degree represents the proportion of the amount by mole of the hydroxy group produced by saponifying a polyvinyl acetate to the amount by mole of the polyvinyl alcohol produced by the saponification reaction. In the following description, a saponification degree refers to a value measured by the method specified in JIS K 6726. The average polymerization degree of the polyvinyl alcohol may be 2,000 or more, and is desirably 2,000 or more and 5,000 or less. The average polymerization degree mentioned herein is the viscosity average polymerization degree measured by the method specified in JIS K 6726.

For preparing the ink receiving layer coating liquid, it is desirable to use the polyvinyl alcohol or a derivative thereof in the form of aqueous solution. In this instance, the content of the polyvinyl alcohol or the polyvinyl alcohol derivative in the aqueous solution is desirably 3% by mass or more and 20% by mass or less.

Crosslinking Agent

The first ink receiving layer may further contain a crosslinking agent. Examples of the crosslinking agent include aldehyde compounds, melamine compounds, isocyanate compounds, zirconium-based compounds, amide-based compounds, aluminum-based compounds, and boric acid and salts thereof. These crosslinking agents may be used singly or in combination. In particular, if polyvinyl alcohol or a derivative thereof is used as the binder, boric acid or a salt thereof is advantageously used.

Boric acid may be orthoboric acid ($H_3BO_3$), metaboric acid $(HBO_2)_n$, and hypoboric acid ($H_4B_2O_4$). The salt of the boric acid may be a water-soluble salt of any of these boric acids. Salts of the boric acids include alkali metal salts, such as sodium borate and potassium borate; alkaline-earth metal salts, such as magnesium borate and calcium borate; and ammonium salts. Among these compounds, orthoboric acid is advantageous from the viewpoint of the stability of the coating liquid with time and the effect of reducing the occurrence of cracks.

The amount of the crosslinking agent to be used can be appropriately controlled according to the manufacturing conditions and other factors. The proportion of the crosslinking agent in the ink receiving layer may be 1.0% by mass or more and 50% by mass or less, such as 5% by mass or more and 40% by mass or less, relative to the mass of the binder.

If polyvinyl alcohol is used as the binder and boric acid and/or a salt thereof is used as the crosslinking agent, the proportion of the total mass of the boric acid and the salt thereof in the ink receiving layer may be 5% by mass or more and 30% by mass or less relative to the mass of the polyvinyl alcohol.

Other Additives

The first ink receiving layer may further contain other additives. Examples of such additives include a pH adjuster, a thickener, a fluidity improving agent, an antifoaming agent, a foam suppressor, a surfactant, a release agent, a penetrant, a coloring pigment, a coloring dye, a fluorescent brightening agent, an ultraviolet absorbent, an antioxidant, a preservative, a fungicide, a water-resistant additive, a dye fixing agent, a curing agent, and a weather-resistant material.

Second Ink Receiving Layer

In the present embodiment, the second ink receiving layer contains a colloidal silica having an average primary particle diameter of 50 nm or more and 100 nm or less, and a polyvinyl alcohol having a silanol group. Colloidal Silica Having Average Primary Particle Size of 50 nm to 100 nm Advantageously, the colloidal silica is in the form of spherical particles. The term "spherical" used herein implies that colloidal silica particles (50 to 100 particles) observed through a scanning electron microscope have an average major axis a and an average minor axis with a b/a ratio of 0.80 or more and 1.00 or less. The b/a ratio is desirably 0.90 or more and 1.00 or less, such as 0.95 or more and 1.00 or less. Advantageously, the colloidal silica is cationic. More specifically, the spherical cationic colloidal silica may be Cartacoat K303C (produced by Clariant) or MP-1040 (produced by Nissan Chemical Industries).

The second ink receiving layer may contain other inorganic particles in addition to the colloidal silica particles. Examples of inorganic particles include particles of titanium dioxide, zeolite, kaolin, talc, hydrotalcite, zinc oxide, zinc hydroxide, aluminum silicate, calcium silicate, magnesium silicate, zirconium oxide, and zirconium hydroxide. The inorganic particle content in the second ink receiving layer may be 50% by mass or more and 98% by mass or less, such as 70% by mass or more and 96% by mass or less.

The average primary particle diameter of the colloidal silica can be determined by measuring the diameters (largest diameter if not spherical) of 50 particles of the colloidal silica randomly selected from electron micrographs of the particles taken through a scanning electron microscope S-4300 (manufactured by Hitachi) at a magnification of 50,000 times, and averaging the measured diameters.

Desirably, the colloidal silica accounts for 60% or more of a cross section in the region within a depth of 300 nm from the outermost surface of the recording medium. In other words, in the cross section, the percentage of the presence of the colloidal silica (area where the colloidal silica is present/area of the recording medium viewed for observation) is desirably 60% or more. This suggests that a large part of the colloidal silica is present about the outermost surface of the recording medium. This helps the colloidal silica produce the intended effect thereof. If the percentage of the above-described presence of the colloidal silica is less than 60%, the recording medium may not exhibit satisfactory glossiness. The percentage of the presence of the colloidal silica can be determined as below.

The recording medium is cut to expose a cross section thereof with a microtome EM UC6/FS6 (manufactured by Leica), and a photograph of the cross section is taken through a scanning electron microscope S-4300 (manufactured by Hitachi) at a magnification of 50,000 times. Then, the number of particles present in the cross section is counted. The particles are all visually counted including particles fully exposed at the cross section, particles covered with other colloidal silica particles, and particles partially hidden in the boundary of the view for observation. (The percentage of the presence can therefore exceed 100%.) The counting of the number of particles is performed in at least three fields of view, and the average of the counts is defined as the number of particles. Assuming properly spherical particles, the area A1 (particle radius×particle radius×circular constant×number of particles) where the colloidal silica is present is calculated using the average primary particle diameter and the number of particles. Also, area A2 of the field viewed for observation is calculated. The percentage of the presence of colloidal silica particles is A1/A2×100.

Desirably, the colloidal silica accounts for 70% or more of the outermost surface of the recording medium. In other words, the percentage of the presence of the colloidal silica at the outermost surface (area where the colloidal silica is present/area viewed for observation) is desirably 70% or more. This suggests that a large part of the colloidal silica is present at the outermost surface of the recording medium. This helps the colloidal silica produce the intended effect thereof. If the percentage of the above-described presence of the colloidal silica is less than 70%, the recording medium may not exhibit satisfactory glossiness. The percentage of this presence of the colloidal silica can be determined as below.

A photograph of the surface of the recording medium is taken through a scanning electron microscope S-4300 (manufactured by Hitachi) at a magnification of 50,000 times. The particles are all visually counted including particles fully exposed at the surface, particles covered with other colloidal silica particles, and particles partially hidden in the boundary of the view for observation. The counting of the number of particles was performed in at least three fields of view, and the average of the counts is defined as the number of particles. Assuming properly spherical particles, the area B1 (particle radius×particle radius×circular constant×number of particles) where the colloidal silica is present is calculated using the average primary particle diameter and the number of particles. Also, area B2 of the field viewed for observation is calculated. The percentage of the presence of colloidal silica at the surface is B1/B2×100.

Polyvinyl Alcohol Having Silanol Group

In the present embodiment, the second ink receiving layer contains a polyvinyl alcohol having a silanol group as a binder.

The binder content in the second ink receiving layer is desirably 50% by mass or less, such as 30% by mass or less, relative to the colloidal silica content. Also, the binder content in the second ink receiving layer is desirably 5.0% by mass or more, such as 8.0% by mass or more, in view of the binding property of the ink receiving layer.

Crosslinking Agent and Other Additives

The second ink receiving layer may further contain a crosslinking agent and other additives as described as those of the first ink receiving layer.

Method for Manufacturing Recording Medium

Although the recording medium of the present embodiment can be manufactured by any method without particular limitation, the method for manufacturing the recording medium may include preparing ink receiving layer coating liquids, and applying the ink receiving layer coating liquids to the substrate. The method for manufacturing the recording medium will now be described.

Preparation of Substrate

The base paper of the substrate may be prepared by an ordinary paper making process. Exemplary paper-making machines include a Fourdrinier machine, a cylinder machine, a drum machine, and a twin wire machine. The base paper may be subjected to surface treatment to enhance the smoothness of the surface thereof by applying heat and pressure during or after paper making. The surface treatment may be performed by calendaring, such as machine calendering or super calendering.

For forming a resin layer over the base paper, that is, for coating the base paper with a resin, melt extrusion, wet lamination or dry lamination may be applied. Melt extrusion, in which the base paper is coated by extruding a molten resin onto either or both sides of the base paper, is advantageous. For example, a method called extrusion coating is widely used in which a transported base paper and a resin sheet extruded from an extrusion die are brought into contact with each other at a nip point between a nip roller and a cooling roller and pressed with the nip so that the base paper is coated with the resin. If the resin layer is formed by melt extrusion, pretreatment may be performed to increase the adhesion between the base paper and the resin layer. The pretreatment may be performed by acid etching with a mixed solution of sulfuric acid and chromic acid, gas flame treatment, UV exposure, corona discharge, glow discharge, or anchor coating of, for example, alkyl titanate. Among these pretreatment techniques, corona discharge treatment is advantageous. For forming a resin layer containing a white pigment, the base paper may be coated with a mixture of a resin and the white pigment.

Formation of Ink Receiving Layers

The ink receiving layers may be formed on the substrate by the following procedure. First, an ink receiving layer coating liquid is prepared. Then, the coating liquid is applied to the substrate and is then dried to yield the recording medium. The application of the coating liquid may be performed using a coater, such as a curtain coater, an extrusion coater, or a coater using a slide hopper method. The coating liquid may be heated during being applied. For drying the applied coating liquid, a hot air dryer may be used, such as a linear tunnel dryer, an arch dryer, an air loop dryer, or a sine curve air flow dryer, or any other dryer may be used, such as IR dryer, heating dryer, or microwave dryer.

The recording medium of the present embodiment may be obtained by a simultaneous multilayer application of a first coating liquid containing the fumed silica and the binder and a second coating liquid containing the colloidal silica and the polyvinyl alcohol having a silanol group. The "simultaneous multilayer application" mentioned herein is a method for forming a plurality of ink receiving layers by forming layers of a plurality of coating liquids on a surface of a sloping slide and then transferring the multilayer structure of the coating liquids onto a substrate. The term "simultaneous" used herein implies that a plurality of layers are not formed by applying coating liquids in a plurality of steps (as in a process in which, for example, two layers are formed one by one in their respective steps), but in a single step. The simultaneous multilayer application enables efficient formation of the recording medium satisfying the specific percentage of the presence of the colloidal silica in a cross section of the recording medium in the region within a depth of 300 nm from the outermost surface of the recording medium.

The amount of an ink receiving layer coating liquid applied for forming an ink receiving layer may be 8 g/m$^2$ or more and 45 g/m$^2$ or less after drying. Such an ink receiving layer coating liquid content facilitates the formation of an ink receiving layer having an above-mentioned desired thickness. The amount of the first coating liquid applied is desirably 8 g/m$^2$ or more and 45 g/m$^2$ or less, such as 15 g/m$^2$ or more and 42 g/m$^2$ or less, after drying. The amount of the second coating liquid applied is desirably 0.1 g/m$^2$ or more and 3.0 g/m$^2$ or less, such as 0.3 g/m$^2$ or more and 2.0 g/m$^2$ or less, after drying.

EXAMPLES

The present disclosure will be further described in detail with reference to Examples and Comparative Examples. The invention is however not limited to the following Examples. In the following Examples, "part(s)" is on a mass basis unless otherwise specified.

Preparation of Recording Media

Formation of Water-Resistant Substrate

A paper stock was prepared by mixing 80 parts of LBKP having a Canadian standard freeness of 450 mL, 20 parts of NBKP having a Canadian standard freeness of 480 mL, 0.60 part of cationized starch, 10 parts of ground calcium carbonate, 15 parts of precipitated calcium carbonate, 0.10 part of alkylketene dimer, and 0.030 part of cationic polyacrylamide, and adding water to the mixture so as to have a solid content of 3.0% by mass. Subsequently, paper making using the paper stock was performed with a Fourdrinier machine, followed by three-step wet press and drying with a multicylinder dryer. Then, the resulting sheet was soaked with an aqueous solution of oxidized starch and dried so that the solid content after drying with a size press machine would be 1.0 g/m$^2$. The sheet was then finished by machine calendering to yield a 100 μm thick base paper having a basis weight of 170 g/m$^2$, a Stöckigt sizing degree of 100 s, an air permeance of 50 s, a Bekk smoothness of 30 s, and a Gurley stiffness of 11.0 mN. Subsequently, a resin composition containing 70 parts of a low-density polyethylene, 20 parts of a high-density polyethylene and 10 parts of titanium oxide was applied onto one side (front side) of the base paper so that the amount of the coating would be 25 g/m$^2$ after being dried. Subsequently, a resin composition containing 50 parts of a low-density polyethylene and 50 parts of a high-density polyethylene was applied onto the other side of the base paper so that the amount of the coating would be 25 g/m$^2$ after being dried, and thus a water-resistant substrate was completed.

Preparation of Inorganic Particle Dispersion Liquids

Fumed Silica Dispersion Liquid

Into a suction disperser/mixer Conti-TDS (manufactured by YSTRAL) were added 420 parts of ion exchanged water and 5 parts of dimethyldiallylammonium chloride homopolymer SHALLOL DC-902P (produced by Dai-ichi Kogyo Seiyaku). Furthermore, 100 parts of a fumed silica AEROSIL 300 (average primary particle diameter: 7 nm, produced by Nippon Aerosil) was slowly added, and the materials were dispersed in each other for 24 hours to a yield fumed silica dispersion liquid with a solid content of 20% by mass.

Colloidal Silica Dispersion Liquid

The colloidal silica dispersion liquids shown in Table 1 were used.

TABLE 1

Colloidal Silica Dispersion Liquids

| Product name | Manufacturer | Average primary particle diameter (nm) |
|---|---|---|
| ST-AK-L | Nissan Chemical | 45 |
| ST-AK | Industries | 15 |
| MP-1040 | | 100 |
| PL-5 | Fuso Chemical | 50 |
| PL-20 | | 200 |
| CartacoatK303C | Clariant | 80 |

Preparation of Ink Receiving Layer Coating Liquids

First Ink Receiving Layer Coating Liquid

The fumed silica dispersion liquid, a polyvinyl alcohol PVA 235 (produced by Kuraray) as a binder, and orthoboric acid as a crosslinking agent were mixed in a proportion (fumed silica:binder:crosslinking agent) of 100:22:4 on a solid basis to prepare a first ink receiving layer coating liquid.

Second Ink Receiving Layer Coating Liquid

The above-prepared colloidal silica dispersion liquid, a polyvinyl alcohol PVA 235 (represented as PVA in Table 2) or a silanol-modified polyvinyl alcohol R-1130 (produced by Kuraray, represented as silanol-modified PVA in Table 2) as a binder, orthoboric acid as a crosslinking agent, and Surfynol 440 (produced by Nissin Chemical Industry) that is an acetylenediol-based surfactant were mixed according to the combination shown in Table 2 with a proportion (colloidal silica:binder:crosslinking agent:surfactant) of 100:11:0.4:0.5 on a solid basis to prepare a second ink receiving layer coating liquid.

Preparation of Recording Media

The ink receiving layer coating liquids were applied onto the water-resistant substrate. If two coating liquids were applied, each coating liquid was applied in such an amount that the dried coating would have a weight (g/m$^2$) shown in Table 2. For the application method, the successive application method of allying the first ink receiving layer coating liquid and subsequently applying the second ink receiving layer coating liquid is represented as "Successive", and the simultaneous multilayer application method of simultaneously applying the first and the second ink receiving layer coating liquid using a multilayer slid hopper-type coater is represented as "Simultaneous". The resulting recording media were subjected to measurements for the percentages of the presence of the colloidal silica in a cross section in the region within a depth of 300 nm from the outermost surface of the recording medium and the percentage of the presence of the colloidal silica at the outermost surface of the recording medium in the above-described manner. The results are shown in columns "Cross section" and "Surface" in Table 2.

TABLE 2

| Conditions for Forming Recording Media | | | | | | | |
|---|---|---|---|---|---|---|---|
| | First ink receiving layer | Second ink receiving layer | | | | Percentage of presence of colloidal silica | |
| Recording medium No. | Weight of dried coating ($g/m^2$) | Colloidal silica dispersion liquid | Binder | Weight of dried coating ($g/m^2$) | Application method | Cross section | Surface |
| Recording medium 1 | 22.00 | CartacoatK303C | Silanol-modified PVA | 2.20 | Simultaneous | 103 | 95 |
| Recording medium 2 | 22.00 | CartacoatK303C | Silanol-modified PVA | 2.00 | Simultaneous | 100 | 92 |
| Recording medium 3 | 22.00 | CartacoatK303C | Silanol-modified PVA | 1.60 | Simultaneous | 96 | 89 |
| Recording medium 4 | 22.00 | CartacoatK303C | Silanol-modified PVA | 1.20 | Simultaneous | 94 | 86 |
| Recording medium 5 | 22.00 | CartacoatK303C | Silanol-modified PVA | 1.00 | Simultaneous | 90 | 84 |
| Recording medium 6 | 22.00 | CartacoatK303C | Silanol-modified PVA | 0.60 | Simultaneous | 81 | 80 |
| Recording medium 7 | 22.00 | CartacoatK303C | Silanol-modified PVA | 0.40 | Simultaneous | 70 | 71 |
| Recording medium 8 | 22.00 | CartacoatK303C | Silanol-modified PVA | 0.30 | Simultaneous | 61 | 65 |
| Recording medium 9 | 22.00 | CartacoatK303C | Silanol-modified PVA | 0.25 | Simultaneous | 42 | 60 |
| Recording medium 10 | 22.00 | CartacoatK303C | Silanol-modified PVA | 0.10 | Simultaneous | 15 | 32 |
| Recording medium 11 | 22.00 | PL-5 | Silanol-modified PVA | 1.20 | Simultaneous | 93 | 85 |
| Recording medium 12 | 22.00 | MP-1040 | Silanol-modified PVA | 1.20 | Simultaneous | 96 | 88 |
| Recording medium 13 | 22.00 | CartacoatK303C/ AEROSIL300 (90:10 on a mass basis) | Silanol-modified PVA | 1.20 | Simultaneous | 82 | 77 |
| Recording medium 14 | 22.00 | CartacoatK303C | Silanol-modified PVA/PVA (80:20 on a mass basis) | 1.20 | Simultaneous | 93 | 86 |
| Recording medium 15 | 22.00 | CartacoatK303C | Silanol-modified PVA/PVA (50:50 on a mass basis) | 1.20 | Simultaneous | 91 | 85 |
| Recording medium 16 | 22.00 | CartacoatK303C | Silanol-modified PVA/PVA (20:80 on a mass basis) | 1.20 | Simultaneous | 92 | 85 |
| Recording medium 17 | 22.00 | CartacoatK303C | Silanol-modified PVA | 1.20 | Successive | 109 | 99 |
| Recording medium 18 | 22.00 | PL-5L/ CartacoatK303C | Silanol-modified PVA | 1.20 | Simultaneous | 94 | 85 |
| Recording medium 19 | 22.00 | | Not applied | | — | 0 | 0 |
| Recording medium 20 | 22.00 | ST-AK | Silanol-modified PVA | 1.20 | Simultaneous | 90 | 85 |
| Recording medium 21 | 22.00 | ST-AL-L | Silanol-modified PVA | 1.20 | Simultaneous | 92 | 88 |
| Recording medium 22 | 22.00 | PL-20 | Silanol-modified PVA | 1.20 | Simultaneous | 98 | 86 |
| Recording medium 23 | 22.00 | CartacoatK303C | PVA | 2.20 | Simultaneous | 105 | 94 |
| Recording medium 24 | 22.00 | CartacoatK303C | PVA | 1.60 | Simultaneous | 98 | 90 |
| Recording medium 25 | 22.00 | CartacoatK303C | PVA | 1.20 | Simultaneous | 92 | 85 |
| Recording medium 26 | 22.00 | CartacoatK303C | PVA | 0.30 | Simultaneous | 62 | 66 |
| Recording medium 27 | 22.00 | CartacoatK303C | PVA | 1.20 | Successive | 110 | 100 |
| Recording medium 28 | — | CartacoatK303C | Silanol-modified PVA | 1.20 | Successive | 104 | 98 |
| Recording medium 29 | — | CartacoatK303C | PVA | 1.20 | Successive | 105 | 99 |

Evaluations

In each evaluation, ratings AA to B represent that the results were good, and ratings C and D represent that the results were unacceptable. For recording images for the following evaluations, an ink jet recording apparatus PIXUS MP 990 (manufactured by Canon) with an ink cartridge BCI-321 (manufactured by Canon) was used. The recording was performed at a temperature of 23° C. and a relative humidity of 50%. In the use of the ink jet recording apparatus, the duty of recording performed in such a manner that an ink droplet of about 11 ng is applied to a unit area of 1/600 inch×1/600 inch at a resolution of 600 dpi×600 dpi is defined as 100%.

Ink Absorbency

The ink absorption was measured by Bristow method specified in JAPAN TAPPI No. 51-87 for 108 ms from the time of contact with the recording medium, using a recording ink having a surface tension of 37 mN/m at 25° C. It is known that the ink absorption measured by Bristow method has a correlation with the ink absorbency when an image is recorded with an ink jet recording apparatus.

The evaluation results are shown in Table 3.

AA: Ink absorption was 18.5 $mL/m^2$ or more.

A: Ink absorption was 17.1 $mL/m^2$ or more and less than 18.5 $mL/m^2$.

B: Ink absorption was 16.0 $mL/m^2$ or more and less than 17.1 $mL/m^2$.

C: Ink absorption was 15.1 $mL/m^2$ or more and less than 16.0 $mL/m^2$.

D: Ink absorption was less than 15.0 $mL/m^2$.

Color Developability of Recorded Image

A black solid pattern was formed on each of the recording media at a recording duty of 100% using the above-mentioned ink jet recording apparatus. The color developability of the resulting images was evaluated by measuring the optical density of the solid pattern with an optical reflection densitometer 530 (spectro-densitometer, manufactured by X-Rite). The evaluation results are shown in Table 3.

AA: Optical density was 2.30 or more.

A: Optical density was 2.20 or more and to less than 2.30.

B: Optical density was 2.10 or more and less than 2.20.

C: Optical density was 2.00 or more and less than 2.10.

D: Optical density was less than 2.00.

Scratch and Abrasion Resistance

The scratch resistance of the recording media was examined using a Gakushin-type rubbing tester II in accordance with JIS L 0849 (manufactured by Tester Sangyo). More specifically, the examination was performed as below. The recording medium was placed with the ink receiving layer up on the vibration table of the rubbing tester. A rubber with a weight of 100 g thereon is provided with a disposable paper wiper (Kimtowel) and was subjected to five reciprocal slide operations on the surface of the recording medium. Then, the 20° glossinesses of the rubbed region and the unrubbed region was measured, and the difference between them (=(20° glossiness of the rubbed region)−(20° glossiness of the unrubbed region)) was calculated. The 20° glossiness was measured by the method specified in JIS Z 8741. The rating criteria were as follows. The evaluation results are shown in Table 3.

AA: Difference in 20° glossiness was less than 2%.

A: Difference in 20° glossiness was 2% or more and less than 5%.

B: Difference in 20° glossiness was 5% or more and less than 10%.

C: Difference in 20° glossiness was 10% or more and less than 15%.

D: Difference in 20° glossiness was 15% or more.

Glossiness

The 20° glossiness was measured by the method specified in JIS Z 8741, and rated according to the following criteria. The evaluation results are shown in Table 3.

AA: 20° glossiness was 25% or more.

A: 20° glossiness was 20% or more and less than 25%.

B: 20° glossiness was 15% or more and less than 20%.

C: 20° glossiness was 10% or more and less than 15%.

D: 20° glossiness was less than 10%.

TABLE 3

Evaluation Results

| Example No. | Recording medium No. | Evaluation: Ink absorbency | Color developability | Scratch and abrasion resistance | Glossiness |
|---|---|---|---|---|---|
| Example 1 | Recording medium 1 | B | B | B | AA |
| Example 2 | Recording medium 2 | B | B | A | AA |
| Example 3 | Recording medium 3 | B | B | A | AA |
| Example 4 | Recording medium 4 | A | A | AA | AA |
| Example 5 | Recording medium 5 | A | AA | AA | AA |
| Example 6 | Recording medium 6 | AA | AA | A | AA |
| Example 7 | Recording medium 7 | AA | AA | A | AA |
| Example 8 | Recording medium 8 | AA | AA | B | A |
| Example 9 | Recording medium 9 | AA | AA | B | B |
| Example 10 | Recording medium 10 | AA | AA | B | C |
| Example 11 | Recording medium 11 | B | A | AA | AA |
| Example 12 | Recording medium 12 | AA | A | AA | AA |
| Example 13 | Recording medium 13 | AA | AA | A | AA |
| Example 14 | Recording medium 14 | A | A | AA | AA |
| Example 15 | Recording medium 15 | A | A | A | AA |
| Example 16 | Recording medium 16 | B | B | B | AA |
| Example 17 | Recording medium 17 | B | B | B | AA |
| Example 18 | Recording medium 18 | A | AA | AA | AA |
| Comparative Example 1 | Recording medium 19 | AA | AA | D | D |
| Comparative Example 2 | Recording medium 20 | D | D | C | AA |
| Comparative Example 3 | Recording medium 21 | C | B | B | AA |
| Comparative Example 4 | Recording medium 22 | AA | C | AA | A |
| Comparative Example 5 | Recording medium 23 | D | D | C | AA |
| Comparative Example 6 | Recording medium 24 | D | D | C | AA |
| Comparative Example 7 | Recording medium 25 | C | B | C | AA |
| Comparative Example 8 | Recording medium 26 | A | A | C | A |
| Comparative Example 9 | Recording medium 27 | D | C | C | AA |
| Comparative Example 10 | Recording medium 28 | C | D | C | AA |
| Comparative Example 11 | Recording medium 29 | D | D | B | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-209477, filed Oct. 10, 2014, which is hereby incorporated by reference herein in its entirety.

What is claimed is:

1. A recording medium comprising in the following order:

a water-resistant substrate;

a first ink receiving layer; and a second ink receiving layer being an outermost layer, wherein the first ink receiving layer contains a fumed silica and a binder; and the second ink receiving layer contains a colloidal silica having an average primary particle diameter of 50 nm or more and 100 nm or less, and a polyvinyl alcohol having a silanol group, wherein the colloidal silica accounts for 84% or more and 99% or less at an outermost surface of the recording medium, and wherein the colloidal silica accounts for 60% or more of a cross section of the recording medium in the region within a depth of 300 nm from the outermost surface of the recording medium.

2. The recording medium according to claim 1, wherein the water-resistant substrate is a resin-coated substrate including a base paper and a resin layer.

3. The recording medium according to claim 1, wherein the fumed silica has an average secondary particle diameter of 50 nm or more and 300 nm or less.

4. The recording medium according to claim 1, wherein the recording medium is produced by simultaneous multilayer application that is performed by simultaneously applying a first coating liquid containing the fumed silica and the binder and a second coating liquid containing the colloidal silica and the polyvinyl alcohol having a silanol group onto the water-resistant substrate.

5. The recording medium according to claim 4, wherein the amount of the first coating liquid applied is 15 g/m$^2$ or more and 43 $g/m^2$ or less after being dried, and the amount of the second coating liquid applied is 0.3 $g/m^2$ or more and 2.0 $g/m^2$ or less after being dried.

6. The recording medium according to claim 1, wherein the colloidal silica in combination with the polyvinyl alcohol having a silanol group increases pore size of the recording medium.

7. The recording medium according to claim 1, wherein the colloidal silica having an average primary particle diameter of 80 nm or more and 100 nm or less.

8. The recording medium according to claim 1, wherein the content of the polyvinyl alcohol having the silanol group relative to a content of a binder in the second ink receiving layer is 50% by mass or more and 100% by mass or less.

9. The recording medium according to claim 1, wherein the colloidal silica accounts for 84% or more and 88% or less at an outermost surface of the recording medium.

* * * * *